United States Patent [19]

Honda et al.

[11] Patent Number: 4,481,919

[45] Date of Patent: Nov. 13, 1984

[54] INTAKE/EXHAUST VALVE ASSEMBLY FOR AN INTERNAL COMBUSTION ENGINE

[75] Inventors: Shoichi Honda, Tokyo; Nobuo Anno, Urawa, both of Japan

[73] Assignee: Honda Giken Kogyo Kabushiki Kaisha, Tokyo, Japan

[21] Appl. No.: 447,158

[22] Filed: Dec. 6, 1982

[30] Foreign Application Priority Data

Dec. 7, 1981 [JP] Japan ..... 56-196634
Dec. 7, 1981 [JP] Japan ..... 56-196635

[51] Int. Cl.[3] ..... F02D 13/06

[52] U.S. Cl. ..... 123/198 F; 123/90.16; 123/90.36; 123/90.46

[58] Field of Search ..... 123/198 F, 90.15, 90.16, 123/90.27, 90.36, 90.46

[56] References Cited

U.S. PATENT DOCUMENTS

| | | | |
|---|---|---|---|
| 4,151,817 | 5/1979 | Mueller | 123/198 F |
| 4,167,931 | 9/1979 | Iizuka | 123/198 F |
| 4,188,933 | 2/1980 | Iizuka | 123/198 F |
| 4,200,081 | 4/1980 | Meyer et al. | 123/198 F |
| 4,203,397 | 5/1980 | Soeters, Jr. | 123/198 F |
| 4,249,488 | 2/1981 | Siegla | 123/198 F |
| 4,249,489 | 2/1981 | Bruder et al. | 123/198 F |
| 4,284,042 | 8/1981 | Springer | 123/198 F |
| 4,336,775 | 6/1982 | Meyer | 123/198 F |

*Primary Examiner*—Ira S. Lazarus
*Attorney, Agent, or Firm*—Birch, Stewart, Kolasch & Birch

[57] ABSTRACT

A simplified intake/exhaust valve assembly for an internal combustion engine which has a change-over operation of operative and inoperative state of the intake/exhaust valve is provided. The intake/exhaust valve assembly comprises a reciprocating valve having a valve stem and a valve head placed at a position at which an inlet/exhaust port opens into a power cylinder of the engine, to open and close the inlet/exhaust port in accordance with an axial movement thereof, a camshaft driven by a crankshaft of the engine, having a cam surface formed on the circumferential surface thereof, a cam follower having a first end associated with an end of the valve stem, a second end which forms a supporting point thereof, and a bearing surface contactable with the cam surface of the cam shaft, the cam follower being adapted to translate a rotation of the camshaft into the axial movement of the reciprocating valve so as to open and close the inlet/exhaust port in accordance with the rotation of the camshaft when the cam follower is made operative, and a support means comprising, a piston plunger having a head portion for supporting the second end of the cam follower, a cylindrical member for slidably receiving the piston plunger and having a hydraulic pressure chamber formed therein, and a retainer member for slidably receiving the cylindrical member, the cylindrical member being axially slidable in the retainer member between predetermined first and second positions in which the cam follower is made operative and inoperative respectively.

6 Claims, 11 Drawing Figures

INTAKE/EXHAUST VALVE ASSEMBLY FOR AN INTERNAL COMBUSTION ENGINE

BACKGROUND OF THE INVENTION

1. Field of the Invention

The present invention relates to an intake/exhaust valve assembly for an internal combustion engine which is adapted to drive intake/exhaust valves provided to each power cylinder of an internal combustion engine, and more specifically to an intake/exhaust valve assembly which is capable of suspending the open and close operation of a part of intake and exhaust valves under a specific operational condition of the engine.

2. Description of the Prior Art

A type of internal combustion engine is known in which each of power cylinders is provided with a plurality of intake or exhaust valves, for example, 4 valves per cylinder or 6 valves per cylinder.

In order to maintain a sufficient efficiency of the valve operation when the engine is operating at high speed, and to eliminate the blow-by of the mixture due to a so called "overlap" of the valve timing when the engine is operating at medium or low speed, it is preferable to provide an internal combustion engine of the type described above with the function of suspending the operation of a part of intake or exhaust valves when the engine is operating at medium or low speed.

Such a type of intake/exhaust valve assembly is disclosed, for example, in Japanese Patent provisional publication No. 54-36415.

In the case of the prior art valve assembly, however, there were several drawbacks that the construction of the assembly tends to be excessibly complicated, and therefore the durability thereof was not enough.

SUMMARY OF THE INVENTION

An object of the present invention is therefore to provide an intake/exhaust valve assembly for an internal combustion engine having the function of suspending the valve operation, which has a relatively simple stractural arrangement and therefore an improved durability.

According to the present invention, an intake/exhaust valve assembly for an internal combustion engine including a crankshaft, a power cylinder, inlet and exhaust ports communicated to the power cylinder, comprises a reciprocating valve having a valve stem and a valve head placed in a position in which the inlet/exhaust port opens into the power cylinder, to open and close the inlet/exhaust port in accordance with an axial movement thereof, a camshaft driven by the crankshaft, having a cam surface formed on the circumferential surface thereof, a cam follower having a first portion associated with an end of the valve stem, a second portion which forms a supporting point thereof, and a bearing surface contactable with the cam surface of the camshaft, the cam follower being adapted to translate a rotational movement of the camshaft into the axial movement of the reciprocating valve so as to open and close the inlet/exhaust port in accordance with the rotation of the camshaft when the cam follower is made operative, and a support means comprising, a piston plunger having a head portion for supporting the second portion of the cam follower, a cylindrical member for slidably receiving the piston plunger and having a hydraulic pressure chamber therein, and a retainer member for slidably receiving the cylindrical member, the cylindrical member being axially slidable in the retainer member between predetermined first and second positions in which the cam follower is made operative and inoperative respectively.

According to another aspect of the present invention, an intake/exhaust valve assembly for an internal combustion engine including a crankshaft, a power cylinder, inlet and exhaust ports communicated to the power cylinder, comprises a reciprocating valve having a valve stem and a valve head placed in a position in which the inlet/exhaust port opens into the power cylinder, to open and close the inlet/exhaust port in accordance with an axial movement thereof, a camshaft driven by the crankshaft, having a cam surface formed on the circumferential surface thereof, a cam follower having a first portion associated with an end of the valve stem, a second portion which forms a support point thereof and a bearing surface contactable with the cam surface of the camshaft, the cam follower being adapted to translate a rotational movement of the camshaft into the axial movement of the reciprocating valve so as to open and close the reciprocating valve in accordance with the rotation of the camshaft when the cam follower is made operative, and a support means comprising, a cylindrical support member including a support end for supporting the second end of the cam follower, the cylindrical support member having at least one protrusion projecting at substantially right angle to a longitudinal axis thereof, a retainer member for slidably and rotatably receiving the cylindrical support member, the retainer member having an opening portion for receiving the protrusion the cylindrical support member, the cylindrical support member axially slidable between predetermined first and second positions in which the cam follower is made operative and inoperative respectively, a spring member for applying a biasing force on the cylindrical support member for urging the same to the first position, and a positioning member associated with the protrusion of the cylindrical support member for moving the cylindrical support member along a longitudinal axis thereof between the first and second positions and holding the cylindrical support member at the second position against the biasing force whereby maintaining the inlet/exhaust valve inoperative.

The foregoing and other objects and advantages of the present invention will become more clearly understood upon review of the following description taken in conjunction with the accompanying drawings.

DESCRIPTION OF A PREFERRED EMBODIMENT

Figure 1:
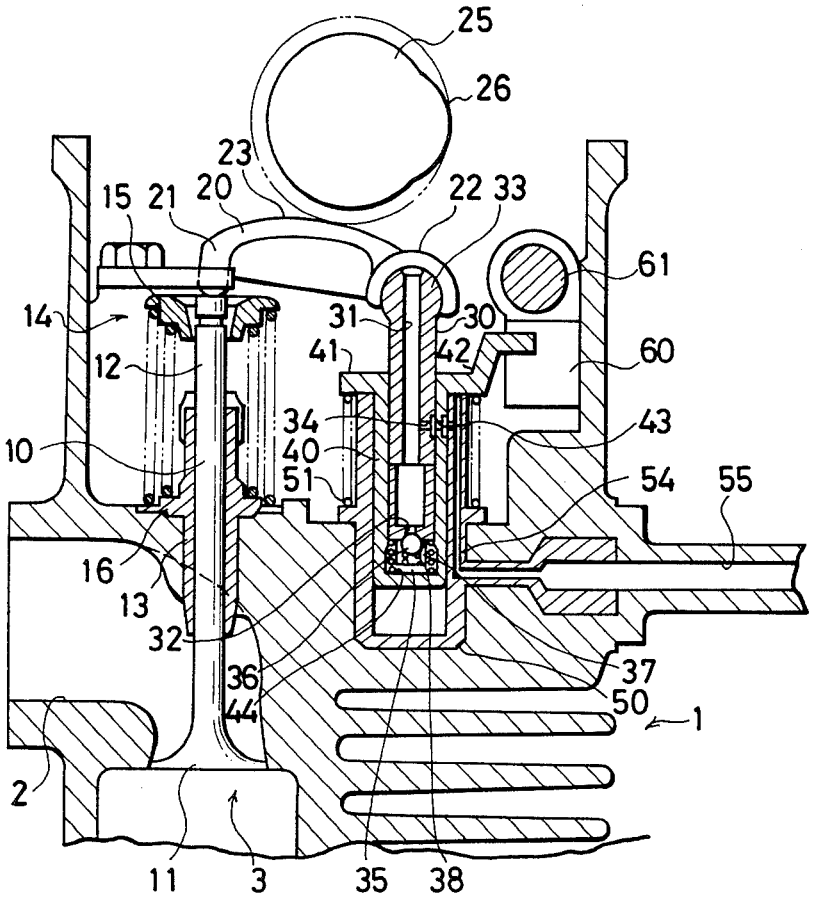
FIG. 1 is a sectional view of an intake/exhaust valve assembly of an internal combustion engine according to the present invention.

Reference is first made to FIG. 1 in which a portion of a cylinder block of an internal combustion engine provided with the intake/exhaust valve assembly is illustrated.

As shown, an intake or exhaust valve body 10 is provided at a top portion of a power cylinder 3 which is formed in a cylinder block generally designated by 1. A valve head 11 of the valve body 10 is placed at a position at which an inlet or exhaust port 2 opens into the power cylinder 3. A valve stem 12 of the valve body 10 is slidably received in a valve stem guide 13 which is fixed in a bore formed in the cylinder block 1 so that the valve head 11 opens and closes the inlet/exhaust port in accordance with an axial movement thereof. A valve spring 14 is held between a valve spring retainer 15 fixed to the valve stem 12 and a flange portion 16 formed integrally with the valve stem guide 13 so as to urge the valve body 10 in the direction to close the inlet/exhaust port 2. A top portion of the valve stem 12 is in abutment with an end 21 of a cam follower 20 which is supported at an another end 22 thereof which is formed into a hollow socket. A bearing surface 23 is formed on the upper face of the cam follower 20 so as to slidably contact with a cam surface 26 formed on the circumference of a camshaft 25 which is driven by a crankshaft (not shown) of the engine. The rotational movement of the camshaft 25 is thus translated into a reciprocating movement of the valve body 10 by means of the cam follower 20 when the latter is held in an operative position. The end 23 of the cam follower 20 is held by a spherical head portion 33 of a piston plunger 30 which is received in a cylindrical support member 40. The piston plunger 30 has an axial passage 31 which opens at the spherical head portion 33 and the lower end portion of the piston plunger 30 so as to communicate with a pressure chamber 35 formed at the bottom of the cylindrical support member 40 and to supply a lubrication oil to the surface of the spherical head portion 33 of the piston plunger 30 which contacts with the hollow socket of the cam follower 20. An orifice 34 is formed in the side wall of the piston plunger 30 and communicates with an orifice 43 formed in the side wall of cylindrical support member 40. A ball valve 36 supported by a spring 37 in a retainer 38 is placed at the lower side of an orifice 32 disposed at the lower end of the piston plunger 30 to form a check valve. A spring 44 is placed in the pressure chamber 35 so as to urge the piston plunger 30 upward.

Figure 2:
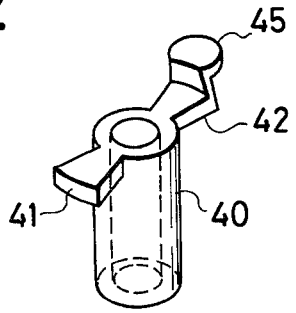
FIG. 2 is a perspective view of a cylindrical member of intake/exhaust valve assembly shown in FIG. 1.

As shown in FIG. 2, the cylindrical support member 40 is further provided with a pair of protrusions 41 and 42 which substantially radially extends from a periphery of an upper opening portion thereof.

The cylindrical support member 40 is axially slidably received in a retainer member 50 which is fixed to the cylinder block 1. A return spring 51 is provided concentrically around the retainer member 50, between a flange portion formed on the retainer member 50 and the protrusions of the cylindrical support member 40 to urge the latter upward.

Figure 3:
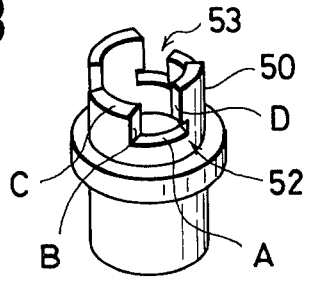
FIG. 3 is a perspective view of a retainer member for receiving the cylindrical member shown in FIG. 1.

As clearly shown in FIG. 3, the retainer member 50 is provided with a pair of recesses 52 and 53 each comprises three faces A, B, and C which form a step portion. At a position under a face D which is opposite to the upright face B, there is formed a latch recess which is engageable with the protrusion 41 or 42 of the cylindrical support member 40.

Figure 5:
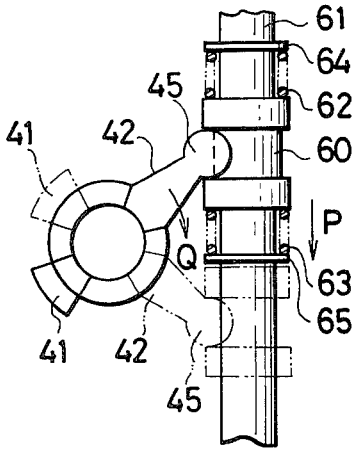
FIG. 5 is a plan view of an arrangement of a positioning mechanism portion of the intake/exhaust valve assembly of the present invention.

As shown in FIG. 5, the protrusion 42 is provided with a round plate portion 45 which is engageable with a holder member 60 mounted on a shift rod 61 so as to rotate the cylindrical support member 40 around the longitudinal axis thereof with the reciprocating motion of the shift rod 61. The cylindrical support member 40 rotates in the direction Q with the movement of the shift rod in the direction P shown in FIG. 5, for example. Furthermore, a pair of springs 62 and 63 are placed at both sides of the holder member 60 and supported by a pair of stop members 64 and 65 so as to apply a balanced biasing force on the holder member 60.

An appropriate drive means is connected to the shift rod 61 to move the cylindrical support member 40 between first and second positions corresponding to the operative and inoperative states of the cam follower 20, in accordance with the operational condition of the engine. The operation of the positioning of the cylindrical support member 40 will be described later more specifically.

Returning to FIG. 1, the retainer member 50 is provided with a hydraulic pressure passage 54 which is communicable with the orifice 43 of the cylindrical support member 40 only when the latter is held in the raised (first) position for enabling the operation of the cam follower 20. The hydraulic pressure passage 54 is further communicated with a source of the hydraulic pressure via a conduit 55.

The operation of the valve assembly according to the present invention will be described hereinafter. When the inlet/exhaust valve body 10 is to be made operative, the cylindrical support member 40 is placed at a position shown by the solid line in FIG. 5 by means of the operation of the shift rod 61. In this position, the protrusions 41 and 42 of the cylindrical support member are supported by the faces C of the recesses 52 and 53, and therefore the cylindrical support member 40 and the cam follower 20 are held at a raised position in which the cam follower 20 is swung by the rotation of the camshaft 25 to press the valve stem 12 against the resilient force of the valve spring 14 and open the valve.

Figure 4:
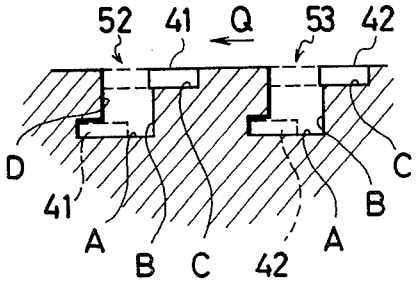
FIG. 4 is an expansion plan of the retainer member shown in FIG. 3.
Figure 6:
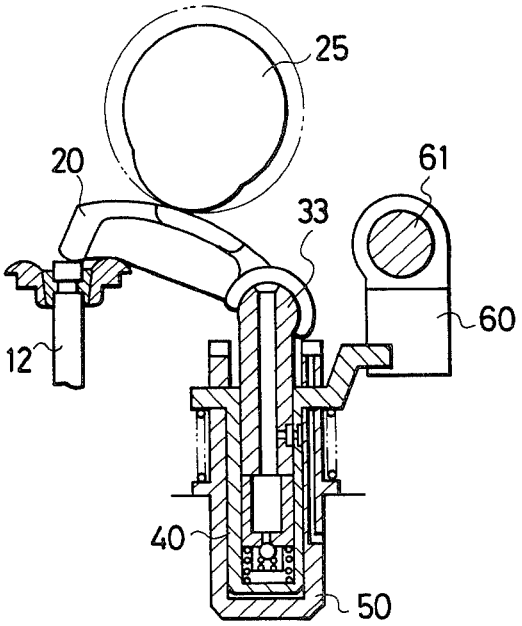
FIG. 6 is a sectional view of the valve assembly showing a state in which the valve is made inoperative.

When the inlet/exhaust valve is to be made inoperative in spite of the rotation of the camshaft 25, the shift rod 61 is moved in the direction shown by the arrow P of FIG. 5 so as to rotate the cylindrical support member 40 in the direction shown by the arrow Q in FIGS. 4 and 5. Therefore, the protrusions 41 and 42 of the cylindrical support member 40 are laterally moved to positions shown by dashed lines in FIG. 4. In this state, when the cam follower 20 is pressed by the cam surface of the camshaft 25, the cylindrical support member 40 is pressed down in the retainer 50 and the protrusions 41 and 42 reach the bottom of the recesses 52 and 53. At this time, with the resilient force of the springs 62 and 63, the protrusions 41 and 42 are moved into the latch recesses and held therein. In this way, the cam follower 20 is held in a lowered (second) position and no more transmit the movement of the camshaft 25 to the valve stem 12. FIG. 6 shows this inoperative state of the cam follower 20.

To the contrary, if the shift rod 61 is moved in the direction opposite to the arrow P of FIG. 5, the protrusions 41 and 42 of the cylindrical support member 40 are moved laterally in the direction opposite to the arrow Q of FIGS. 4 and 5, and disengaged from the latch recesses. Then, the cylindrical support member 40 is raised by the resilient force of the return spring 51 and the protrusions 41 and 42 are further moved laterally in the direction opposite to the arrow Q, and held by the surface C. In this way, the cam follower 20 is replaced to the first raised position and the valve is made operative again.

It should be noted that the durability of the valve assembly is prolonged as compared with the prior art mechanisms since the cam follower 20 is held in the lowered position against the resilient force of the return spring 51 in which the movement of the camshaft is not transmitted to the cam follower 20. Further, this position is maintained by a simple engagement of the protrusions 41 and 42 of the cylindrical support member in the latch recesses formed on the retainer member 50.

In addition to the above feature, the supply of the hydraulic pressure is suspended by stopping the communication between the passage 54 in the retainer member 50 and the orifice 43 of the cylindrical support member 40 when the cam follower 20 is held in the inoperative position. It is advantageous to eliminate the tendancy to raise the position of the piston plunger 30 that would cause a delay of the valve operation due to the depression of the piston plunger 30 before the complete rising of the cylindrical support member 40 during restarting of valve operation.

Moreover, the movement of the shaft rod 61 is simplified by the provision of the springs 62 and 63 which ensures a smooth operation of positioning of the protrusions 41 and 42 on the surface C or in the latch recess formed on the retainer member 50.

Figure 7:
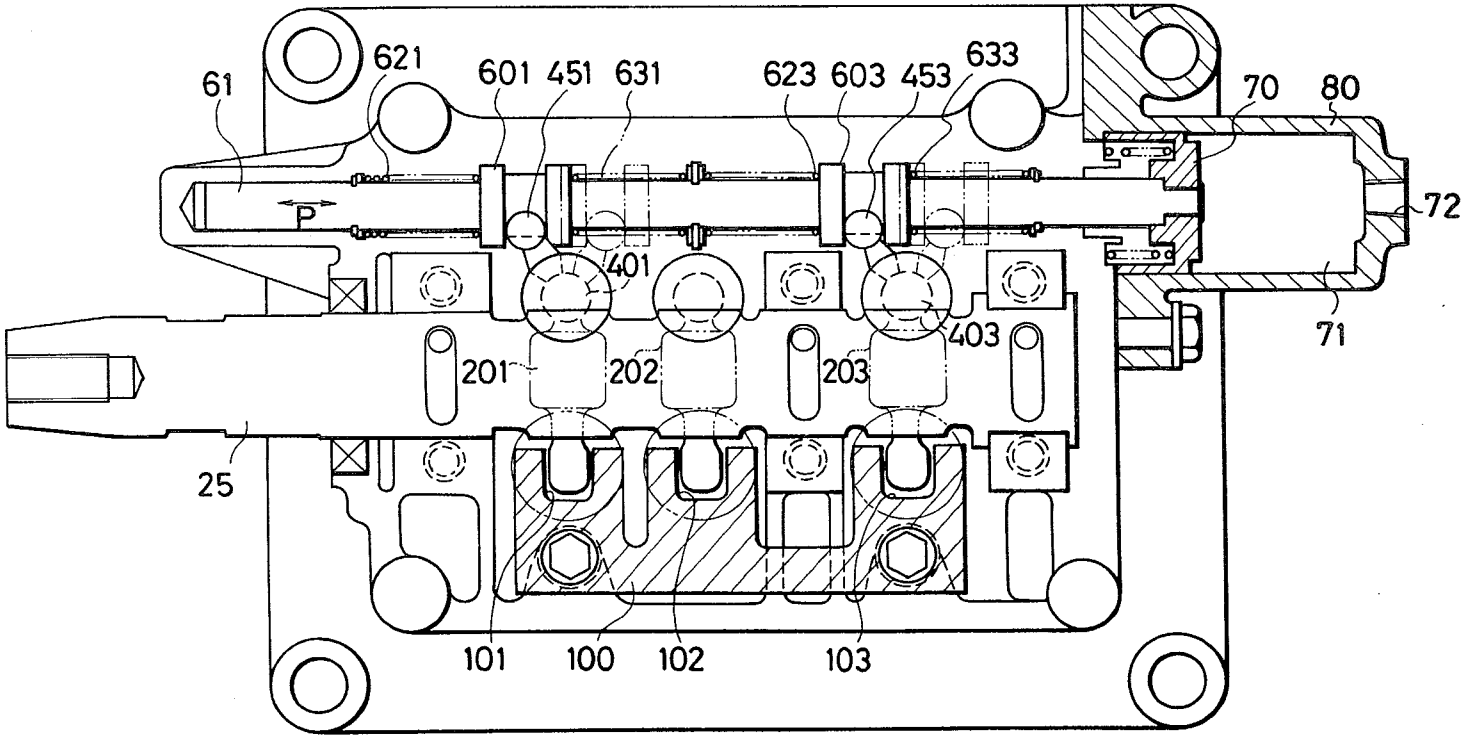
FIG. 7 is a plan view of an internal combustion engine provided with the intake/exhaust valve assembly of the present invention.

Turning to FIG. 7 an arrangement of valve assembly according to the present invention in an internal combustion engine will be explained.

As shown, a camshaft 25 is mounted on a cylinder block of the engine and three cam followers 201, 202, and 203 are respectively associated with the camshaft 25. In this example, cam followers 201 and 203 are the type having operative/inoperative position as described above. The cam follower 202 is supported in the conventional manner. A shift rod 61 is disposed in parallel to the camshaft 25 and two holder members 601 and 603 are slidably mounted on the shift rod 61. Each of the holder members 601 and 603 are provided with a balanced biasing force by two pair of biasing springs 621, 631 and 623, 633. End portions (round plate portions) 451 and 453 of the cylindrical support members 401 and 403 are held between a pair of flange portions of the holder members 601 and 603 so that the cylindrical support members 401 and 403 are positioned at either of the operative or inoperative position in accordance with the axial displacement of the shift rod 61. Furthermore, a cam follower guide 100 having guide portions 101, 102 and 103 is provided to prevent the swing movement of the cam follower around the top end of the valve stem and therefore no guide or holder member is required at the hollow socket portion of the cam follower 20.

The shift rod 61, in this case, is connected to a piston member 70 received in a cylinder member 80 which forms a hydraulic pressure chamber 71 therein. The hydraulic pressure chamber 71 is communicated with a source of hydraulic pressure (not shown) via a supply opening 72. This source of hydraulic pressure supplies the hydraulic pressure to the hydraulic pressure chamber 71 in accordance with the operational condition of the engine. Thus, the position of the piston member, therefore, the position of the shift rod 61 is maintained at a position in which the cylindrical support members 401 and 403 are operative when the engine speed is high, and at a position in which the cylindrical support members 401 and 403 are inoperative when the engine speed is medium or low.

In addition, it is advantageous to reduce the manufacturing cost that single cam follower guide 100 is used for guiding a plurality of cam followers.

Figures 8A, 8B, 8C, 8D:
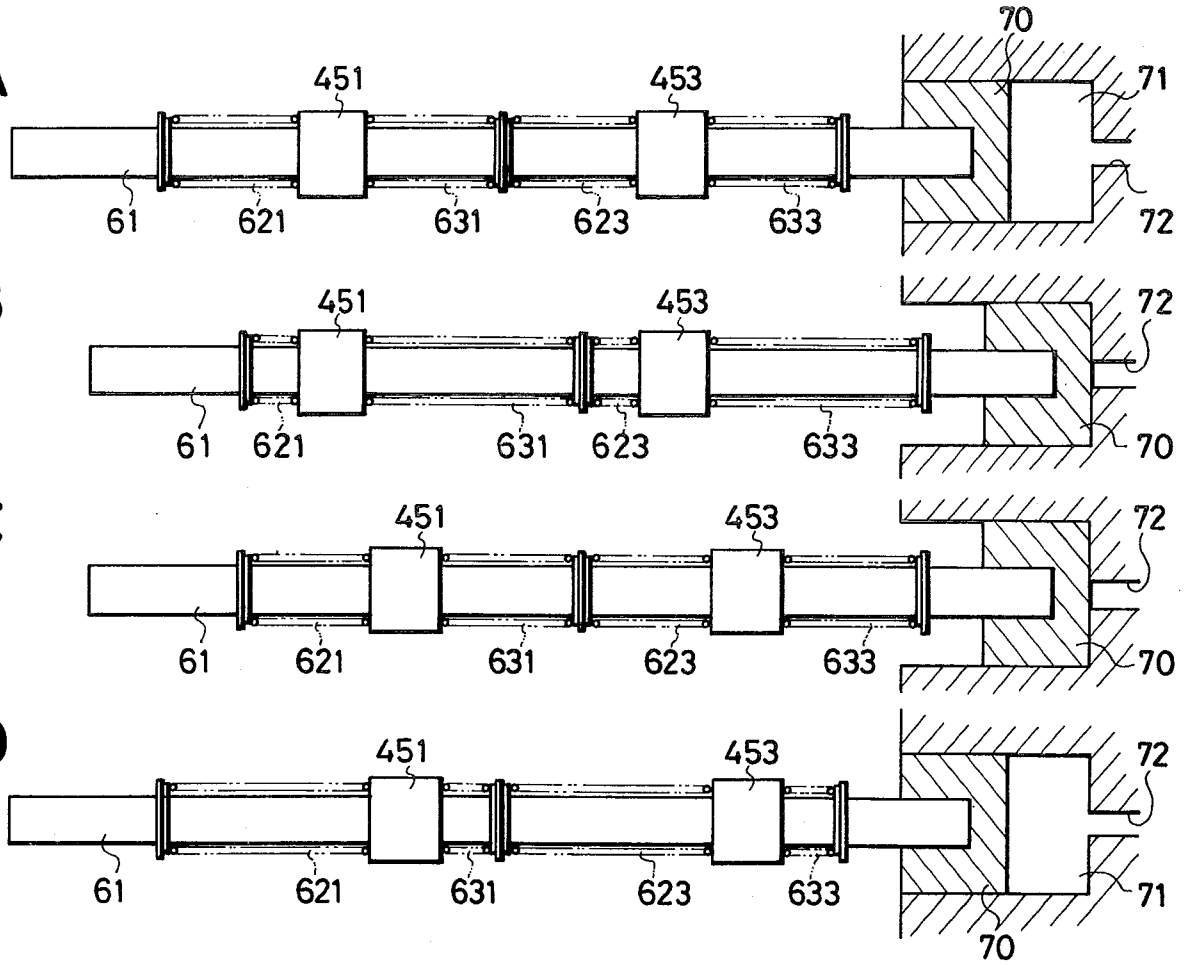
FIGS. 8A through 8D are views showing various operative states of the positioning mechanism portion of the intake/exhaust valve assembly shown in FIG. 7.

Reference is now made to FIG. 8A through FIG. 8D in which various positions of the shift rod 61 and the holder members corresponding to various states of the operational modes of the assembly are illustrated. As shown in FIGS. 8A and 8B, the holder members 451 and 453 remain at its initial position immediately after the movement of the shift rod 61 by the piston member 70. However, the holder members 451 and 453 will be displaced at an appropriate timing in accordance with the resilient force of the biasing springs 621 and 623 as shown in FIG. 8C. Similarly, the movement of the holder members 451 and 453 is delayed when the shift rod 61 return its initial position as shown in FIGS. 8D and 8A. Thus, the changeover operation of the operative and inoperative state of the cam follower by means of the shift rod is made smooth by the operation of the biasing springs.

It will be appreciated from the foregoing, that according to the present invention, the positioning of the cylindrical support member which is used for determining the operative or inoperative state of the cam follower readily and positively effects an axial displacement of a shift rod since the latch and release of the protrusion of the cylindrical support member in the latch recess is automatically executed with the aid of the movement of the end of the cam follower which receives a pressure from the cam surface of the camshaft.

Above, a preferred embodiment of the present invention has been described. It is to be noted, however, that the foregoing descriptions are for illustrative purpose only, and numbers of modifications are possible to those skilled in the art, and the scope of the present invention is limited by only appended claims.

What is claimed is:

1. An intake/exhaust valve assembly for an internal combustion engine including a crankshaft, a power cylinder, inlet and exhaust ports communicated to the power cylinder, comprising:

a reciprocating valve having a valve stem and a valve head placed at a position at which the inlet/exhaust port opens into the power cylinder, to open and close the inlet/exhaust port in accordance with an axial movement thereof;

a camshaft driven by the crankshaft, having a cam surface formed on the circumferential surface thereof;

a cam follower having a first portion associated with an end of said valve stem, a second portion which forms a support point thereof, and a bearing surface contactable with said cam surface of the camshaft, said cam follower being adapted to translate a rotational movement of the reciprocating valve so as to open and close the inlet/exhaust port in accordance with the rotation of said camshaft when said cam follower is made operative; and a support means comprising:

a cylindrical support member including a support end for supporting said second end of said cam follower, said cylindrical support member having at least one protrusion projecting at substantially a right angle to a longitudinal axis thereof;

a retainer member for slidably and rotatably receiving said cylindrical support member, said retainer member having an opening portion for receiving said protrusion of the cylindrical support member, said cylindrical support member being axially slidable in said retainer member between predetermined first and second positions in which said cam follower is made operative and inoperative respectively;

a spring member for applying a biasing force on said cylindrical support member for urging the same to said first position; and a positionning member associated with said protrusion of said cylindrical support member for displacing said cylindrical support member along a longitudinal axis thereof between said first and second positions and holding said cylindrical support member at said second position against said biasing force, whereby maintaining said intake/exhaust valve inoperative.

2. An intake/exhaust valve assembly as claimed in claim 1, wherein said retainer member has an angularly displaced latching recess formed continuously with an end of said opening portion of the retainer member, corresponding to said second position of said cylindrical support member, thereby latching said protrusion of said cylindrical support member when said protrusion is moved at said end of said opening portion.

3. An intake/exhaust valve assembly as claimed in claim 1, wherein said positioning means comprises a positioning member engaged with said protrusion of said cylindrical support member, a guide rod member for supporting said positioning member slidably along a longitudinal axis thereof, and a biasing means placed on both sides of said positioning member.

4. An intake/exhaust valve assembly for an internal combustion engine including a crankshaft, a power cylinder, inlet and exhaust ports communicated to the power cylinder, comprising:

a reciprocating valve having a valve stem and a valve head placed at a position at which the inlet/exhaust port opens into the power cylinder, to open and close the inlet/exhaust port in accordance with an axial movement thereof;

a camshaft driven by the crankshaft, having a cam surface formed on the circumferential surface thereof;

a cam follower having a first portion associated with an end of said valve stem, a second portion which forms a supporting point thereof, and a bearing surface contactable with said cam surface of the camshaft, said cam follower being adapted to translate a rotational movement of the camshaft into the axial movement of the reciprocating valve so as to open and close the inlet/exhaust port in accordance with the rotation of said cam shaft when said cam follower is made operative; and a support means comprising:

a piston plunger having a head portion for supporting said second portion of said cam follower;

a cylindrical member for slidably receiving said piston plunger and having a hydraulic pressure chamber formed therein; and a retainer member for slidably receiving said cylindrical member, said cylindrical member being axially slidable in said retainer member between predetermined first and second positions in which said cam follower is made operative and inoperative respectively.

5. An intake/exhaust valve assembly as claimed in claim 4, wherein said first and second portion of the cam follower are at each end of the cam follower and said bearing surface of the cam follower is placed at an intermediate position of the cam follower.

6. An intake/exhaust valve assembly as claimed in claim 4, wherein said cylindrical member is provided with at least one protrusion which radially extends from a periphery of an opening for receiving said piston plunger, and said retainer member is a retainer cylinder fixed to a body of the engine, and provided with a recess which is engageable with said protrusion of said cylindrical member and wherein said support means further comprises a positioning and driving means for positioning said cylindrical member at a position in which said protrusion of said cylindrical member is engaged in said recess of said retainer cylinder, thereby holding said cam follower at said second position in which said inlet/exhaust valve is made inoperative.

* * * * *